US005630337A

United States Patent [19]

Werth

[11] Patent Number: 5,630,337

[45] Date of Patent: May 20, 1997

[54] APPARATUS AND METHOD FOR FORMING A CONTAINER

[76] Inventor: Elmer D. Werth, 7025 W. 61st Ave., Arvada, Colo. 80003

[21] Appl. No.: 524,480

[22] Filed: Sep. 7, 1995

[51] Int. Cl.[6] ..... B21D 22/28; B21C 3/02

[52] U.S. Cl. ..... 72/349; 72/467; 72/379.4

[58] Field of Search ..... 72/348–351, 336, 72/335, 467, 379.4

[56] References Cited

U.S. PATENT DOCUMENTS

| | | | |
|---|---|---|---|
| 1,412,785 | 4/1922 | Jernberg | 72/349 |
| 3,263,637 | 8/1966 | Cox | 72/349 |
| 4,106,422 | 8/1978 | Buhrke | 113/121 C |
| 4,244,315 | 1/1981 | Klein | 113/121 C |
| 4,587,827 | 5/1986 | Wessels | 72/349 |
| 4,603,571 | 8/1986 | Wessels | 72/349 |

FOREIGN PATENT DOCUMENTS

| | | | |
|---|---|---|---|
| 540708 | 8/1959 | Belgium | 72/348 |
| 68377 | 1/1941 | Czechoslovakia | 72/350 |
| 932217 | 8/1955 | Germany | 72/349 |

OTHER PUBLICATIONS

K. Forth, New Company Has Been Around for Can Manufacturers, Cantech International, Oct./Nov. 1994.

*Primary Examiner*—Daniel C. Crane
*Attorney, Agent, or Firm*—Kyle W. Rost

[57] ABSTRACT

A container body is produced from a blank, by first forming the blank from sheet stock in hexagonal shape, thereby eliminating scrap from the blanking process. A die ring is configured to laterally redistribute material from the point areas of the hexagon into intermediate areas during the draw-and-iron can forming process, usefully incorporating this material instead of trimming it.

8 Claims, 3 Drawing Sheets

APPARATUS AND METHOD FOR FORMING A CONTAINER

TECHNICAL FIELD

The invention generally relates to sheet metal container making, especially to methods of forming or treating a metallic closure and container body. Aspects of the invention relate to the draw and iron method of forming container bodies, including blanking closures or container bodies from sheet stock, cupping, body making, trimming, flanging, closing, and seaming of metal containers. Disclosed is a method of forming containers from sheet stock while utilizing substantially all of the material from the sheet stock and thereby minimizing scrap. The method also is applicable to flowable materials other than metal.

BACKGROUND ART

The manufacture of two piece containers such as metallic beverage cans by the draw and iron process is widely practiced. According to this known technique, sheet metal coil stock is fed into a machine called a cupper. There, the sheet is blanked into round discs of metal. These discs are cut in a close pattern, with the rows nested with each other to the extent possible. However, a web of metal remains behind after the discs are removed, and this web constitutes scrap. The cupper then processes the discs so formed into shallow cups, which are substantially wider in diameter than the finished can body. The scrap may be disposed of an various ways, including reprocessing it into additional sheet stock.

The cups are further processed in a bodymaker machine. Here, a punch pushes each cup through a series of dies. The first die is a redraw die that reduces the diameter of the cup to the eventual diameter of the finished can body. Subsequent dies draw and iron the side walls of the can body, extending them to increased height, generally greater than the finished height of the can. The open end of the can body is quite irregular after bodymaking and, thus, the can body is further processed in a trimming machine. There, the irregular open end is trimmed off, leaving behind a can body of standard dimensions and finished open end edge. The trimmer leaves another scrap, which can be reprocessed to form additional stock.

After trimming, often the can body is further processed by printing a decoration on the outer surface wall and necking-in the open end. With or without necking-in, the can body then is flanged at the open end. At this point, the body may be filled with its intended contents. Once filled, the body is closed by applying a lid over the flanged end and seaming the lid and flanged end.

Many patents disclose details of the draw and iron process of forming container bodies. In all known processes, the blanking step generates scrap between blanks. A recent article, K. Forth, *New Company Has Been Around For Can Manufacturers*, CanTech International, October/November 1994, describes a process for cutting blanks having the shape of a modified hexagon. The process reduces the amount of scrap by allowing a closer blanking pattern. However, scrap still is generated between blanks.

Several patents disclose techniques of saving metal in forming lids, also known as can ends. Of note is U.S. Pat. No. 4,244,315 to Klein, which proposes that lids might be blanked from square blanks, from scrolled strips of metal, or from wide sheet stock, in each case employing a preliminary closure forming step that draws metal from outside the border of the lid. The pattern in which the lids are arranged is a staggered, hexagonal, honeycomb arrangement, intended to produce a maximum number of lids from a given amount of sheet metal. However, it is notable that the lids, when cut from the sheet stock, are circular, leaving behind a substantial scrap at the interstices of the pattern. Other notable art is found in U.S. Pat. No. 4,106,422 to Buhrke, which proposes that lids be formed while remaining integral with the coil stock. Various processing is applied to the lids to finish them to the maximum extent possible before the lids are cut from the stock. Thus, prior to being finally cut, the lids are carried in the stock in a local area of metal having plane geometric outlines. However, when finally cut, the lids are circular and leave behind scrap.

It would be desirable to form container bodies according to generally known techniques of the draw and iron process, but with far less scrap then is presently produced. Such an advancement would improve the efficiency of container manufacturing by producing an increased number of container bodies from a given amount of metal Similarly, this improvement could eliminate a substantial amount of metal reprocessing that currently is required due to the large generation of scrap in all known can body forming processes.

Similarly, it would be desirable to form lids with reduced scrap.

To achieve the foregoing and other objects and in accordance with the purpose of the present invention, as embodied and broadly described herein, the product and method of manufacture of this invention may comprise the following.

DISCLOSURE OF INVENTION

Against the described background, it is therefore a general object of the invention to provide an improved method of forming container bodies, wherein substantially the entire sheet stock is utilized in forming the blanks for the can ends and can bodies.

A more specific object is to define blanking areas of regular geometric, non-circular perimeter, wherein the contained volume of metal is closely similar to the volume conventionally employed in a round blank for forming a similar object.

Another specific object is to provide a method of forming container bodies wherein each blank is in the form of a hexagon, such that the coil stock is substantially entirely consumed by division into juxtaposed hexagons.

A further object is to perform cupping, redrawing, and ironing in such a way as to suitably distribute the metal from a hexagonal blank into a finished can body.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

The invention provides an improved process of forming a container of the type typically formed in the process steps of forming from sheet stock a blank; drawing the blank into a cup; and re-drawing and ironing the cup into a container body having an open end. According to the improvement, in the step of forming from sheet stock a blank, the blank is formed having a geometric shape configured with a plurality of circumferential protrusions at predetermined locations. A device is provided for laterally redistributing material from the predetermined locations of the protrusions. The blank is longitudinally processed through the device for laterally redistributing material from the predetermined locations of the protrusions.

According to another aspect of the invention, in a method of forming a container, sheet stock is provided in a size suited for division into a plurality of container blanks. The sheet stock is separated into a plurality of blanks having a hexagonal shape. Each blank is cupped and thereby formed into a cup. The cup is drawn and ironed and thereby formed into a container body having an open end. The wall of the container body is trimmed near its open end. Then, the open end is flanged.

The accompanying drawings, which are incorporated in and form a part of the specification illustrate preferred embodiments of the present invention, and together with the description, serve to explain the principles of the invention. In the drawings:

BEST MODE FOR CARRYING OUT THE INVENTION

The present invention provides an efficient utilization of metal or other stock material, including plastics and other synthetics, for the manufacture of containers. The disclosed method chiefly is applicable to the production of two-piece containers, such as aluminum or steel beverage cans formed from a body and lid. This technology is described as adapted for use with the conventional steps of draw and iron container manufacturing. While such draw and iron technique is in common use, the invention anticipates that still other techniques might be used and that the invention might be applied to the production of lids as well as container bodies.

Figure 1:
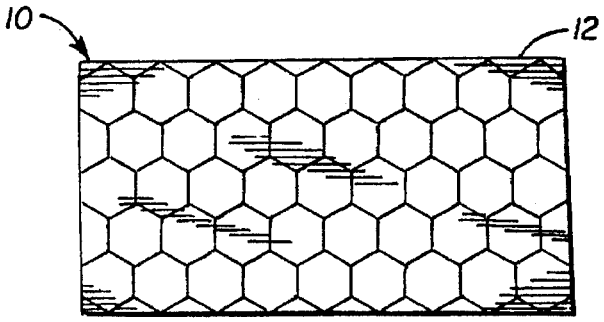
FIG. 1 is a top plan view of a section of sheet stock, showing the preferred, nested pattern of hexagonal blanks for the formation of either container bodies or ends.

With reference to FIG. 1 of the drawings, the method of forming a metal container body or lid is applied to the sheet stock 10 from which the container component is to be manufactured. The sheet stock is provided in a size suited for division into a plurality of container body or end blanks. For example, five or more rows of hexagonal blanks are required to cross the width of the sheet stock 10. While such sheet stock conventionally is divided into a plurality of blanks having circular configuration, the invention provides that the sheet stock be divided, instead, into a plurality of blanks each having a non-circular geometric shape capable of abutting each other to substantially eliminate scrap in the blanking process. In the drawing, regular polygons, each having more than four sides, are selected, with the regular hexagon being the single preferred geometric shape. The hexagon provides high density of blanks with a substantial absence of scrap.

The division of the sheet stock into a plurality of blanks is accomplished by any suitable separating process or means, including cutting, stamping, or other parting operations. The term, "blanking," is applied to this formation of individual sections of metal sheet stock, wherein each section is further processed into the desired component, such as a container body or lid. As applied to this invention, "blanking" means the formation of sections of sheet stock for further processing that will form at least side walls prior to any substantial trimming of metal from the blank. Significantly, the blank is sized to contain substantially the minimum quantity of metal required to form the component, except as manufacturing process later may cause the need for trimming. Thus, this usage of the term, "blanking," is to be distinguished from other usages wherein the segments contain substantial excesses of metal that are trimmed or become scrap before such trimmings are first subjected to substantial forming or processing.

The preferred technique for blanking is to feed the sheet stock into a cupping machine of generally known design, in which the stock is blanked and cupped. Such cupping machine is adapted to define and separate the blanks in nested configuration, such as that shown in FIG. 1, in which each row of blanks is staggered by one-half the dimension of a blank from the neighboring rows. Thus, the interstices between blanks in each row are incorporated into the blanks of the neighboring row to the greatest extent possible. In the case of hexagonal blanks, there are no unused interstices except marginal scrap 12 at the margins of the sheet stock. This utilization of the sheet stock can be said to generate substantially no scrap, since when hexagons are employed, parting from immediately juxtaposed blanks is entirely along common borders. Each blank shares the maximum number of straight sides with immediately juxtaposed neighbors, such that when shapes other than hexagons are used, scrap is minimized.

Figure 2:
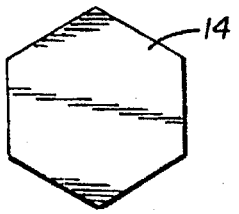
FIG. 2 is an enlarged top plan view of a single hexagonal blank.

FIG. 2 shows a typical regular hexagonal blank, in which each of the six sides is equal in length, and the sides are joined at equal angles. At the junction of each neighboring pair of sides, a point is formed. The material of construction near the point is to be spread laterally, so as to be a useful part of the finished container body or lid. The method and equipment for achieving this spreading will be generally and specifically described below.

Figure 3:
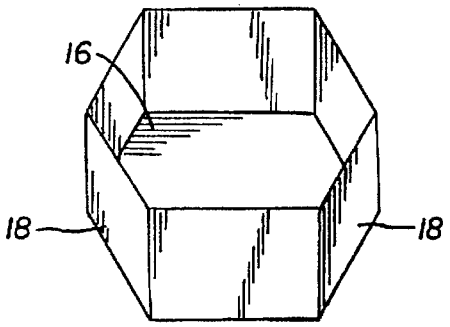
FIG. 3 is an isometric view of a hexagonal-shaped cup formed from the blank of FIG. 2.

The blanks 14, once formed as shown in FIG. 2, then are cupped. In the well known draw and iron process, the cupping machine forms the blank into a shallow cup. Such forming may be accomplished by punching the blank to deform it. The polygonal blank 14 may be processed by punching with a similarly configured punch and die set. Thus, for example, the hexagonal blank 14 can be formed into a hexagonal cup 16 as shown in FIG. 3 by punching it with a hexagonal punch and die set. The side walls 18 of this cup are disposed in the general shape of a hexagon.

Figure 6:
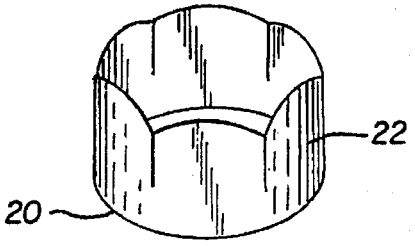
FIG. 6 is an isometric view of a cylindrical cup formed from the blank of FIG. 2 or the hexagonal cup of FIG. 3.

However, if desired, the hexagonal blank 14 can be cupped by applying a cylindrical punch and die set, with the result being the cup 20 shown in FIG. 6. The side walls 22 of cup 20 are disposed in a generally circular shape, such the cup is generally cylindrical. The punch may accommodate the polygonal shape of the blank by allowing extra space between the punch and its forming die, so as to not overly extend the metal near the intersections of the polygon's sides. Alternatively, a specially configured die may be used, as described below. The resulting cup 20 appears to be similar to the cylindrical cups of the prior art, except that the side walls may be relatively thicker at points corresponding to the intersections of the polygon's sides. Alternatively, the cup 20 may have ears where extra metal remains in the side wall.

Figure 4:
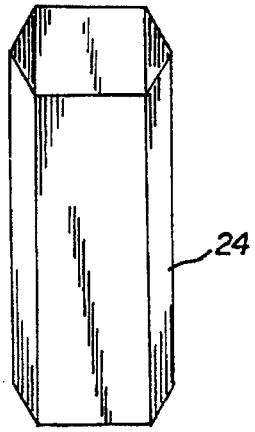
FIG. 4 is an isometric view of a drawn and ironed hexagonal-shaped container body formed from the hexagonal cup of FIG. 3.
Figure 7:
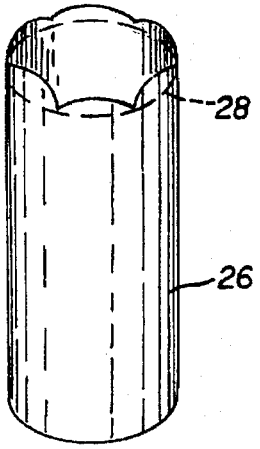
FIG. 7 is an isometric view of a drawn and ironed container body formed from the cup of FIG. 6.

In order to extend the side walls of the cupped blank 20, a drawing and ironing process is employed. Conventionally, a contoured punch pushes the cup through a redraw die, followed by a series of ironing dies. The redraw die reduces the diameter of the cup, while each ironing die extends the side wall of the cup, and a sufficient number of dies are employed to achieve a predetermined length of extension. Typically, the ironing dies interact with the punch to distribute the metal from the cup over the punch in a desired distribution. The resulting product is a container body having an open end with slightly irregular lip. No point of the lip should be shorter than a predetermined height, so that the lip can be trimmed to form an even edge at such predetermined height. The polygonal cup 16 may be drawn and ironed by either of two methods. First, this cup can be processed on a similarly shaped polygonal punch passing through polygonal dies. The resulting container body 24, FIG. 4, has generally polygonal side walls. However, cup 16 also may be processed through a generally circular punch and die set so as to form a cylindrical cup or container body 26, FIG. 7. Cup 20 also may be drawn and ironed through a generally circular punch and die set to produce a container body 26. The punch and die set should be configured to distribute the metal in the cup walls as evenly as possible in the formed body.

Figure 5:
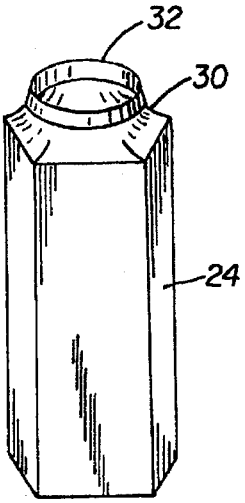
FIG. 5 is an isometric view of a necked-in, hexagonal-shaped container body formed from the body of FIG. 4.

The container body 24 or 26 may be further processed according to generally known techniques. The uneven lip surrounding the open end of the body can be trimmed off at an even height, as shown by the dashed line 28, FIG. 7. If it is desired to neck-in the container side wall at the open end, various equipment is known to employ stationary dies, rotating dies, and orbiting rollers, all capable of forming a substantially circular neck 30, FIG. 5. The trimmed end of a container body then can be die formed or roll formed to define a flange 32, in preparation for filling the container, applying the lid, and seaming the lid to the container.

Figure 8:
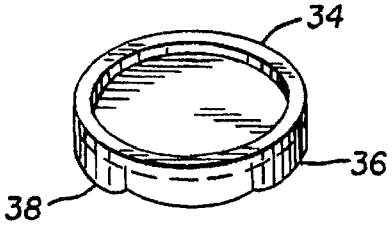
FIG. 8 is an isometric view of a container end formed from the blank of FIG. 2.

A container lid or end 34 is shown in FIG. 8, formed from a hexagonal blank 14. The lid 34 is formed by forcing the blank through a punch and die set similar to those used to form cup 20. The depending ears 36 can be trimmed at the dashed line 38.

Figure 9:
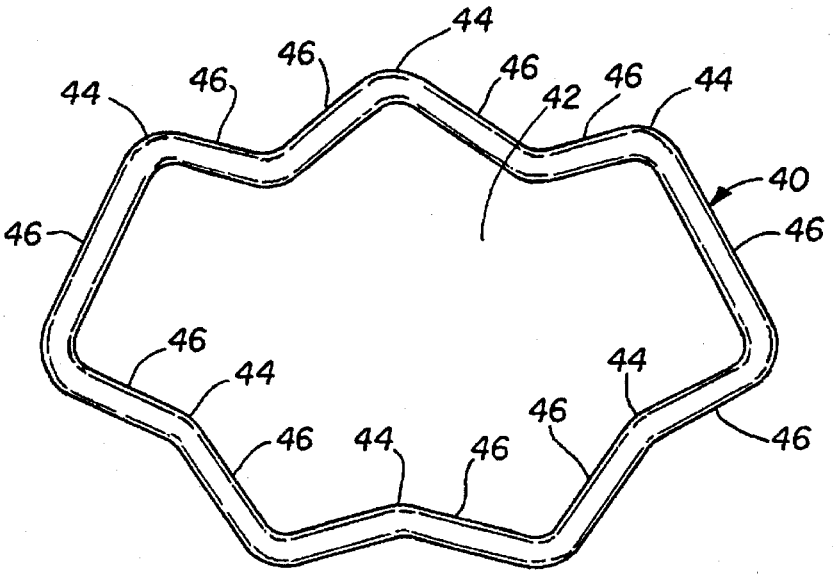
FIG. 9 is an isometric view of a die for converting a hexagonal member into a cylindrical member.

With reference to FIG. 9, a die element 40 works in combination with a punch to transform a hexagonal blank into a cylindrical container body. This die element or its equivalent can be applied after blanking, in the cupping process. Similarly, it may be applied after cupping, in the redrawing process. Still further, it may be applied after the redrawing process, in the ironing process. The die element 40 or its equivalent can be applied in one, some, or all of these steps, as required to produce a container body whose open end is not excessively irregular. Since any draw and iron process produces a certain amount of earing, it is expected that the open end of the can bodies subsequently will be trimmed. Die element 40 is employed to reduce earing that otherwise would result from the presence of extra material at the points of the hexagonal blank.

The die element 40 is used in an ironing ring or similar cupping die or redraw die. It is oriented to lie in an approximately transverse plane to the longitudinal direction of container body movement. The die element has a substantially circular central passageway 42 that accommodates a substantially cylindrical punch, while allowing a clearance betweem the die element and punch that allows passage of the container body, as it known in the art. In one embodiment, if the circular center is viewed as lying in a single plane, the walls of the die form a leading edge configured in a zig-zag pattern, oriented in a perpendicular cylinder to the plane of the circle. The side walls of the die provide a means for locally laterally spreading the sheet material of the can body workpiece, as the workpiece is drawn through the die. The local spreading of the container material takes place in general longitudinal alignment with the points of the hexagonal blank, or those areas of the processed workpiece corresponding to the former position of those points. Those areas of the blank or processed workpiece will be referred to as the point areas, while the areas between the point areas will be referred to as the intermediate areas. The blank or workpiece is processed through the die element 40 with the leading edge portions of the zig-zag wall aligned with the point areas.

In the preferred embodiment, the zig-zag leading edge of the side wall of die element 40 is formed as six longitudinally protruding, generally wedged-shaped apex sections 44, extending in the longitudinal direction of the leading face of the die, which is the die face that is directly opposted to the direction of punch and workpiece movement. Each apex section tapers back along trailing edges 46. A blank 14 or processed workpiece is pushed through the die by a longitudinally moving punch, and the workpiece is reshaped by the die. While conventionial portions of the processing may, for example, extend the workpiece side wall by ironing action, the workpiece material also is shaped and deformed by the apex sections 44, which spread the workpiece material laterally toward the two trailing edges of each wedge, which correspond to the intermediate areas of the workpiece. As previously noted, the blank 14 or processed workpiece is passed through the die with the point areas aligned with the apex sections 44. In this way, the excess of material in the general area of the point areas is laterally or circumferentially distributed, in a plowing type of action.

While the concept of lateral or circumferential displacement is established by a single apex section corresponding to each point area of the workpiece, still other die element configurations could accomplish the same function. For example, an apex section could be formed with plural longitudinally separated apexes, waves, edges or ribs to gradually circumferentially spread the workpiece material as the workpiece successivey encounters each one, while the trailing edges 46 might have only a single edge for performing conventional drawing and ironing functions. Further, the apex could be formed with a sharp leading point, multiple circumferentially juxtaposed leading points, or a soft leading curve substantially without a leading point. All of these structures could be employed as required to locally laterally spread the workpiece material from the point areas to intermediate areas as the drawing and ironing process takes place.

Another means for laterally distributing the material from the point areas is to employ a die 40 element having a slightly irregular radius at the central circular opening, formed to have each die wall area 44 slightly radially closer to the punch than are the trailing edges 46. The excess material at the points areas of the blank are displaced laterally, into the intermediate areas having more clearance with the punch. Thus, the means for circumferentiallly or laterally spreading the workpiece material from the point areas includes any combination of longitudinal or radial variations in the drawing and ironing die working surfaces.

Figure 10:
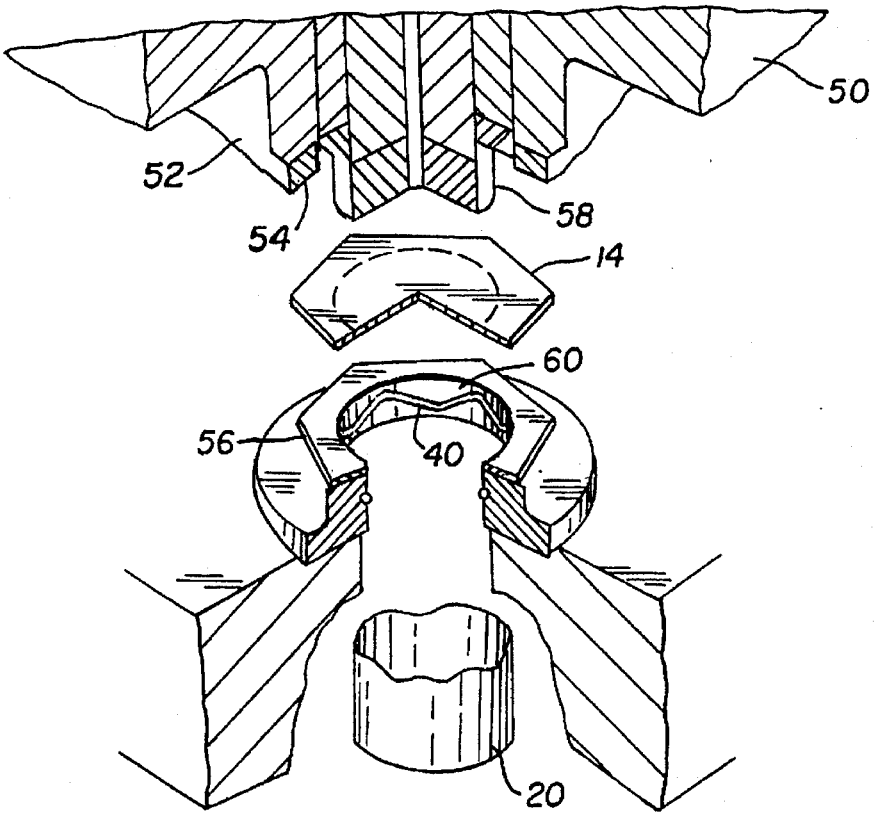
FIG. 10 is an isometric view of one station of a cupmaker for cutting hexagonal blanks and producing cups therefrom.
Figure 11:
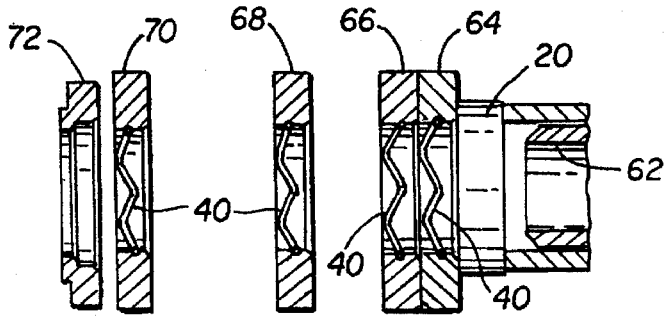
FIG. 11 is a schematic, side elevational view of one station of a bodymaker having dies for processing a cup produced from a hexagonal blank, showing the cup prior to moving through a redraw die.

Because the blank and die must be kept in registration in order to spread material at the correct locations, the blanking and cupping process offers an excellent opportunity to begin redistributing the workpiece material. A cupmaker 50, FIG. 10, is provided with a two part blank cutting die 52. The upper half die 54 and lower half die 56 cooperate to cut blank 14 from sheet stock (not shown) passing between the halves of die 52. In FIG. 10, the die 52 is shown to have a hexagonal configuration for cutting a hexagonal blank 14. As the cutting or blanking is performed, the blank remains engaged and registered in the blanking die. While the blank is so registered, a central punch die tool 58 pushes the blank through a cooperating draw die tool 60, forming the blank into the cup 20. The draw die tool 60 is configured to have a die element 40 on its working surface, positioned to spread the workpiece material laterally from the point areas. The resulting cup 20 may appear very similar to the conventional cup formed from a circular blank. If not, a die element 40 can be applied to the workpiece again in later processing.

FIGS. 11–14 show the sequence of the draw-and-iron process, which is performed in a bodymaker machine. The cup workpiece 20 is removed from the cupping machine and transferred to the bodymaker, where a punch 62 moves the cup workpiece through a further series of dies. Typically, these dies include the redraw die 64, the first ironing die 66, the second ironing die 68, and the third ironing die 70. At the end of this travel, the punch 62 moves the workpiece through a can body stripper 72.

Figure 12:
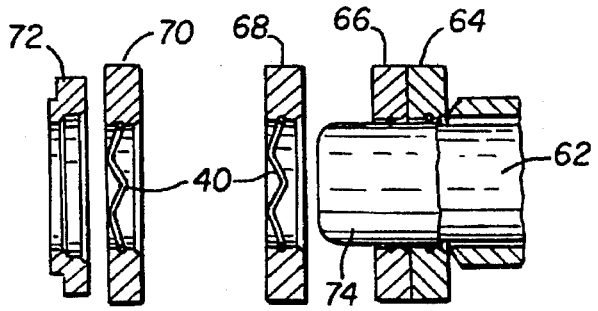
FIG. 12 is a view similar to FIG. 11, showing the can body moving through a redraw die and a first ironing die.
Figure 13:
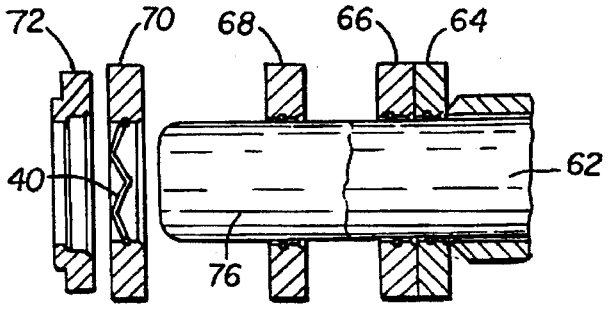
FIG. 13 is a view similar to FIG. 11, showing the can body moving through a second ironing die.
Figure 14:
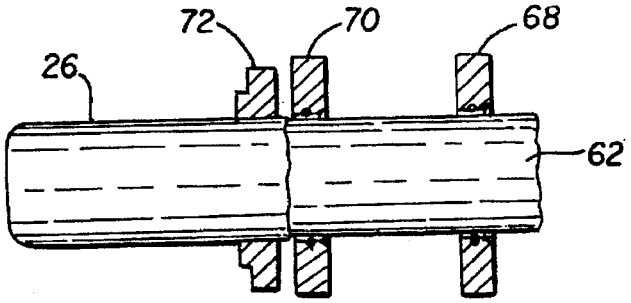
FIG. 14 is a view similar to FIG. 11, showing the can body after movement through a third ironing die.

Each of the dies 64–79 may be configured, as required, with die element 40 at its working face. The workpiece is subjected to lateral spreading of metal or other material from the point areas, by aligning the point areas with the apexes 44 or other spreading structures of die element 40. During conventional can forming steps, the die element 40 performs the added function of circumferentially or laterally redistributing the material from the point areas. Conventionally, the redraw die 64 reduces the diameter of the cup to the desired diameter of the container body and also lengthens the side wall. The ironing dies sequentially reduce the thickness of the side wall and further lengthen it. FIGS. 12 and 13 show the workpieces 74 and 76, respectively, at intermediate points in processing. At the completion of the draw-and-iron process as shown in FIG. 14, the container body 26 has been completed, with the extra metal from the points of the original blank laterally redistributed by die element 40.

Although it is preferred that the lateral redistribution of material be accomplished during conventional can forming steps, this is not required. At any point, the workpiece can be processed in separate steps, by separate apparatus, to accomplish the redistribution.

Through redistribution of the extra metal or other material from the point areas of the hexagonal blank, material that conventionally would be scrap from the skeleton of the sheet stock is converted into intermediate portions of the container body 26. The reduced amount of scrap represents a substantial savings in metal or other material that otherwise must be reprocessed.

The apparatus and method as described above can be applied to forming lids and workpieces having shapes other than cylindrical. For example, by adjusting the cross-sectional shapes of the various appropriate dies, hexagonal cups 16 or container bodies 24 could be produced.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

I claim:

1. An improved process of forming a container, of the type employing the steps of forming from sheet stock a blank; drawing the blank into a cup; and re-drawing and ironing the cup into a container body having an open end; wherein the improvement comprises:

in said step of forming from sheet stock a blank, forming a blank having a geometric shape configured with a plurality of circumferential protrusions at predetermined locations;

providing a means for laterally redistributing material from the predetermined locations of said protrusions, said means including a die element defined by an annular shaping surface for longitudinally processing said blank and having a plurality of wedge-shaped die portions oriented longitudinally both at a leading edge of the die element and within the annular shaping surface; and longitudinally processing the blank through said die element within the annular shaping surface with said wedge shaped die portions aligned with the predetermined locations of the protrusions.

2. The method of claim 1, wherein the geometric shape of said blank is substantially a regular polygon having more than four side edges.

3. The method of claim 2, wherein said step of drawing the blank into a cup further comprises forming said blank into a cup having a side wall disposed substantially in the shape of said regular polygon.

4. The method of claim 3, wherein said step of re-drawing and ironing the cup into a container body having an open end further comprises forming said cup into a container body having a side wall disposed substantially in the shape of said regular polygon.

5. The method of claim 3, wherein said step of re-drawing and ironing the cup into a container body having an open end further comprises forming said cup into a container body having a side wall disposed substantially in the shape of a circle.

6. The method of claim 2, wherein said step of drawing the blank into a cup further comprises forming said blank into a cup having a side wall disposed substantially in the shape of a circle.

7. The method of claim 1, wherein the geometric shape of said blank is substantially a hexagon.

8. An improved apparatus for forming a cylindrical container from a generally hexagonal blank whose circumference is defined by six points separated by flats, for use in combination with a cupper that forms a hexagonal blank from sheet stock and draws the blank into a cylindrical cup, and a body maker that redraws and irons the cup into a container body having an open end; wherein the improved apparatus comprises:

an annular die means having an annular shaping surface for longitudinally processing a blank passing through the center of the die means, having six wedge-shaped die portions oriented longitudinally within the annular shaping surface and at a leading edge of the die element with respect to the processing direction of the blank, wherein in use each of the wedge-shaped die portions is aligned with a respective one of the points and laterally redistributes material from the area of the point to the areas of the juxtaposed flats.

* * * * *